United States Patent [19]

Besler

[11] Patent Number: 4,726,409

[45] Date of Patent: Feb. 23, 1988

[54] EXTERIOR ROLL-UP SHUTTER AND METHOD OF MOUNTING

[76] Inventor: Armin Besler, Kuhlehof 16, 4630 Bochum, Fed. Rep. of Germany

[21] Appl. No.: 794,658

[22] Filed: Nov. 4, 1985

[30] Foreign Application Priority Data

Dec. 1, 1984 [DE] Fed. Rep. of Germany ..... 3443931

[51] Int. Cl.[4] ..... A47H 1/00

[52] U.S. Cl. ..... 160/23 R; 160/26; 160/38

[58] Field of Search ..... 160/19, 23 R, 24, 26, 160/32, 33, 38

[56] References Cited

U.S. PATENT DOCUMENTS

| | | | |
|---|---|---|---|
| 1,781,654 | 11/1930 | Corporon | 160/23 R |
| 1,841,226 | 1/1932 | Van Buren | 160/19 |
| 1,846,320 | 2/1932 | Dixson | 160/26 |
| 1,934,103 | 11/1933 | Traut | 160/23 R |
| 2,025,630 | 12/1935 | Yartyan | 160/23 R |
| 2,580,776 | 1/1952 | Herman | 160/23 R |
| 2,769,491 | 11/1956 | Pitcoff | 160/23 R |
| 2,798,545 | 7/1957 | Busiolano | 160/19 |
| 4,317,480 | 3/1982 | Phelps | 160/23 R |
| 4,531,562 | 7/1985 | Swanson | 160/26 |

*Primary Examiner*—Richard J. Scanlan, Jr.

*Assistant Examiner*—Douglas W. Hanson

*Attorney, Agent, or Firm*—Max Fogiel

[57] ABSTRACT

An exterior roll-up shutter consists of positioning strips that can be mounted on an outside wall on or next to the reveals and of a housing that rests against the strips. The housing is constituted of side walls, a floor, a rear and front wall, and a ceiling. The housing accommodates the shaft and panels of the shutter itself. It has a shutter exit extending along its floor in alignment with guide channels in the positioning strips. The shutter also consists of the paneled shutter itself, which is accommodated in the housing. To facilitate both installation of an exterior roll-up shutter of the same overall type and replacement of the paneled shutter itself, each positioning strip, which consists of a length of section with a shutter offset that is accessible from inside the window aperture, has an accommodation that extends along the whole strip. The accommodation is accessible from the weather side. An auxiliary assembly structure associated with one of the side walls of the housing permanently extends into it at a right angle to the strip. It can be used to lift the housing over the positioning strip until the shutter exit in the floor of the housing is in alignment with the guide channels in the positioning strips, while allowing the housing to be freely maneuvered at its installation level at the window.

23 Claims, 23 Drawing Figures

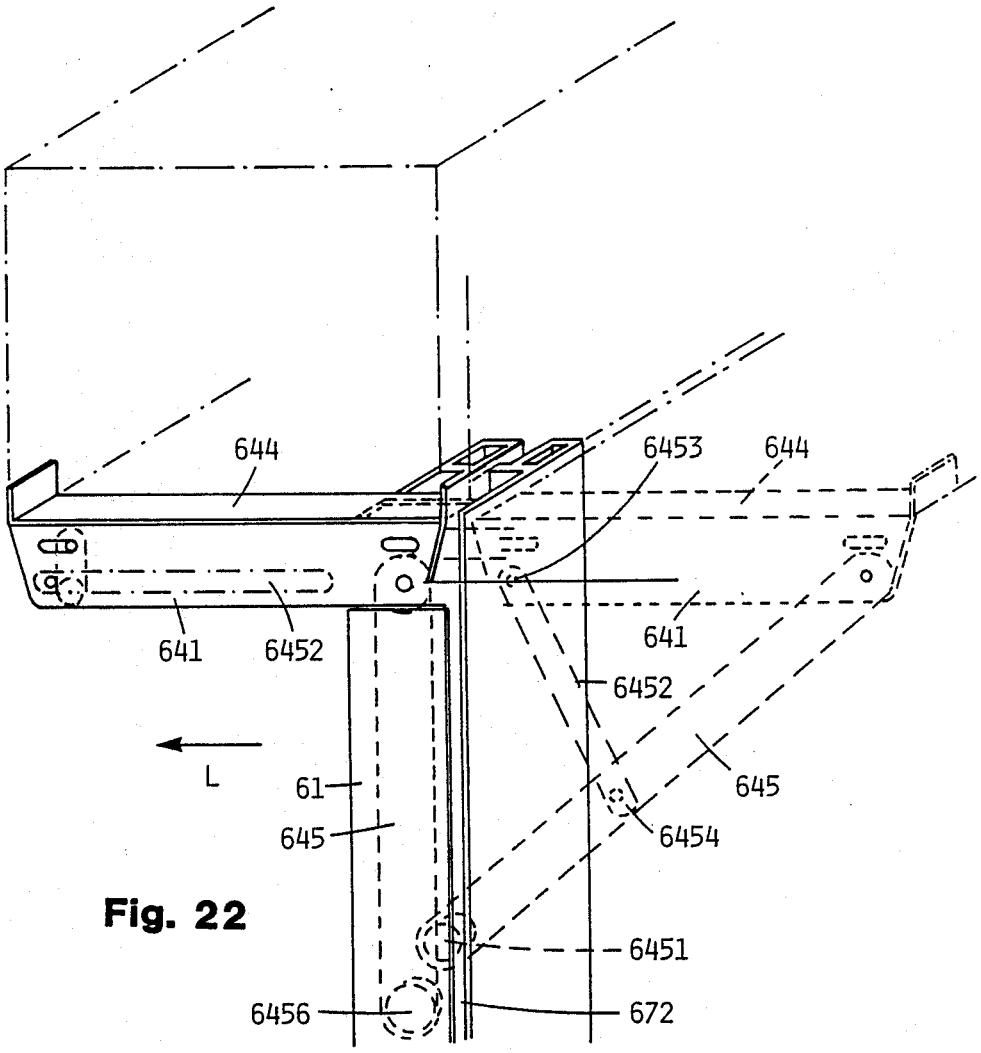
Fig. 22
Fig. 23
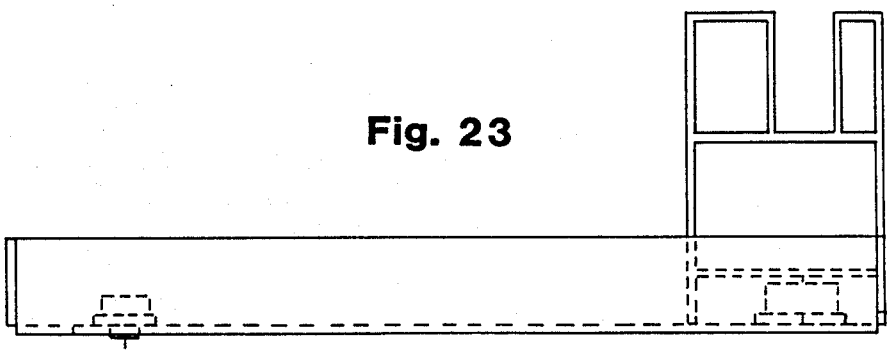

EXTERIOR ROLL-UP SHUTTER AND METHOD OF MOUNTING

BACKGROUND OF THE INVENTION

The present invention relates to an exterior roll-up shutter consisting of positioning strips that can be mounted on an outside wall on or next to the reveals and of a housing that rests against the strips, that is constituted of side walls, a floor, a rear and front wall, and a ceiling, that accommodates the shaft and panels of the shutter itself, and that has a shutter exit extending along its floor in alignment with guide channels in the positioning strips, and of the paneled shutter itself, which is accommodated in the housing.

The invention also relates to a method of mounting such a shutter.

Exterior roll-up shutters are usually installed from the outer, or weather, side. They are also generally accessible only from outside. Repair and maintenance of the type necessitated in the course of adding heat or sound insulation are difficult in known exterior roll-up shutters, in which both the housing and the paneled shutter itself, which is accommodated in the housing, are installed from the top of the guide channels. Furthermore, two installers are usually necessary if the windows are large.

SUMMARY OF THE INVENTION

An object of the present invention is to facilitate both installation of an exterior roll-up shutter of the same overall type and replacement of the paneled shutter itself.

This object is attained in accordance with the invention in an exterior roll-up shutter of the same overall type wherein each positioning strip, which consists of a length of section with a shutter offset that is accessible from inside the window aperture, has an accommodation that extends along the whole strip, that is accessible from the weather side, that an auxiliary assembly structure associated with one of the side walls of the housing permanently extends into at a right angle to the strip, and that can be used to lift the housing over the positioning strip until the shutter exit in the floor of the housing is in alignment with the guide channels in the positioning strips, while allowing the housing to be freely maneuvered at its installation level at the window.

The basic principle allows for various embodiments.

The auxiliary assembly structure can be a plate that rests against the side wall of the housing or an arm that supports the front of the housing.

The supporting arm can be part of the plate that rests against the side wall of the housing.

The auxiliary assembly structure can be guided in the strip by a web that extends over the width or depth of the plate or supporting arm and projects down or by a tongue that extends down from the rear of the plate.

In the latter case, if the auxiliary assembly structure consists of the plate and supporting arm, the supporting arm can be cut out to fit against the positioning strip. The cut-out section of the supporting arm can then be bent down to form a securing tab.

The assembly plate, which extends along the total height of the housing, can have securing tabs that can be bent down against the ceiling of the housing.

The arm that supports the housing can have slots for use in temporarily or permanently securing the housing in various positions in relation to the auxiliary assembly structure.

The end of the positioning web on the auxiliary assembly structure that extends through the slit providing access to the accommodation in the positioning strip can be constituted to provide a hook on the auxiliary assembly structure that engages the accommodation, which accordingly matches it.

The accommodation for the positioning web on the auxiliary assembly structure in the positioning strip can be accessible through a weather-side slit in the positioning strip and have a weather-side offset that extends along the whole strip, and the end of the positioning web can have a retainer that extends into and rotates in the offset.

The accommodation for the positioning web, including the retainer in the positioning web for the auxiliary assembly structure can be accessible from the weather side through a slit that extends along the positioning strip, and its top can be cut out at the rear to admit the web and the retainer.

A bracket can be positioned in such a way that it can rotate and be secured in relation to the positioning web on the weather-side end of the positioning web that is part of the auxiliary assembly structure with its free end leading through the slit that extends along the positioning strip and with a pin that constitutes a retainer in an offset in the accommodation.

A brace can be connected to and released from the positioning web and the bracket.

The accommodation for the positioning tongue on the auxiliary assembly structure that is accessible through the weather-side slit that extends along the positioning strip can have an offset extending along the strip on the weather side, can engage the positioning tongue from the side of the assembly plate facing away from the weather side to the free end, and can have a retainer that leads into the offset and a swing limiter that projects at some distance from the free end into the offset in the positioning strip.

The positioning strips can be made out of lengths of hollow section.

The section can be multichambered, with one of the chambers having a slit that extends along the positioning strip and provides access to the accommodation for the positioning web or tongue that is an integral component of the assembly plate.

The positioning strips can be lengths of hollow plastic section reinforced with lengths of metal section.

To mount the shutter, first, the positioning strips are equipped with the auxiliary assembly structures and fastened either to the reveals of the window that is to be provided with a shutter, leaving enough space between the top of the positioning strips and the platband to accommodate the housing, or next to the reveals on the outside wall, second, the housing with the shutter itself inside it is permanently fastened to the auxiliary assembly structures with the structures resting on the apron wall, third, the housing is slid up the positioning strips to the top of the strips with the auxiliary assembly structures extending into the strips, and finally, the housing is shifted over the top of the positioning strips and the auxiliary assembly structures are secured to the positioning strips with the housing in its final installation position.

In another method of mounting the shutter, first, the positioning strips are equipped with the auxiliary assembly structures and fastened either to the reveals of the window that is to be provided with a shutter, leaving enough space between the top of the positioning strips and the platband to accommodate the housing, or next to the reveals on the outside wall, second, the housing with the shutter itself inside it is temporarily fastened to the auxiliary assembly structures by means of screws extending through slots in the supporting arms that constitute the auxiliary assembly structures into the floor of the housing with the structures resting on the apron wall, third, the housing is slid up the positioning strips to the top of the strips with the auxiliary assembly structures extending into the strips, fourth, the auxiliary assembly structures are permanently secured to the positioning strips, fifth, the screws that temporarily fasten the housing to the auxiliary assembly structures are partly unscrewed and the housing shifted along the structures until the shutter exit in the floor of the housing comes into alignment with the guide channel in each positioning strip, and, finally, the housing is permanently fastened to the auxiliary assembly structures in its final installation position by retightening the screws.

The shutter can easily be installed or mounted by one operator.

It will be necessary as is evident from the description to employ various embodiments while still adhering to the basic principle depending on how the housing matches the window.

Although the basic principle is applicable to housings that are to be installed from outside the window, the principle-installation of the housing for an exterior roll-up shutter with the aid of auxiliary assembly structures that extend along the positioning strips-- can also be applied to a housing that is installed from inside.

Preferred embodiments of the invention will hereinafter be described with reference to the appended drawings. It is to be understood, however, that these are merely by way of example and that the scope of the protection sought for the invention is defined exclusively in the claims.

BRIEF DESCRIPTION OF THE DRAWINGS

FIGS. 22 and 23 are a schematic broken representation of and a horizontal section through a different version of the embodiment illustrated in FIGS. 20 and 21.

DETAILED DESCRIPTION OF THE PREFERRED EMBODIMENTS

Figure 1:
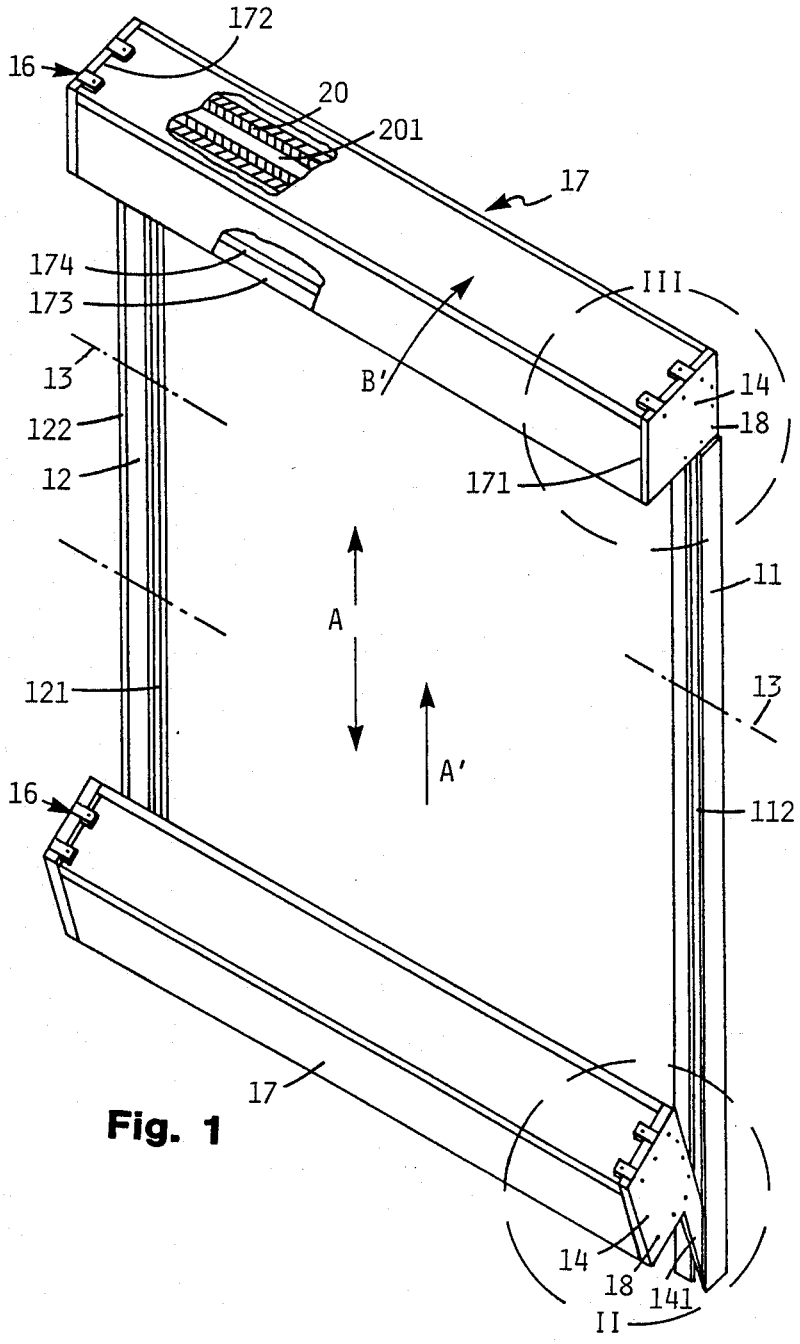
FIG. 1 is a schematic representation of one embodiment of the novel exterior roll-up shutter illustrating the housing during various stages of installation.
Figure 3:
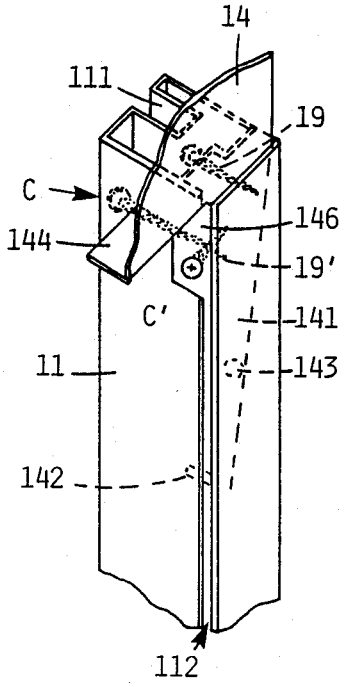
FIG. 3 is a larger-scale detail of area III in FIG. 1 with the housing removed.

The two positioning strips 11 and 12 illustrated in FIG. 1 are positioned against the outside of a wall at the reveals or adjacent to the aperture, neither illustrated, of a window. Each positioning strip has a guide channel 111 (FIG. 3) and a slit 112 and 122 respectively extending along it on the weather side. An assembly plate 14 and 16 respectively is positioned on each strip. Each assembly plate has a tongue 141 that is an integral component of the plate and extends into slit 112 or 122.

Figure 2:
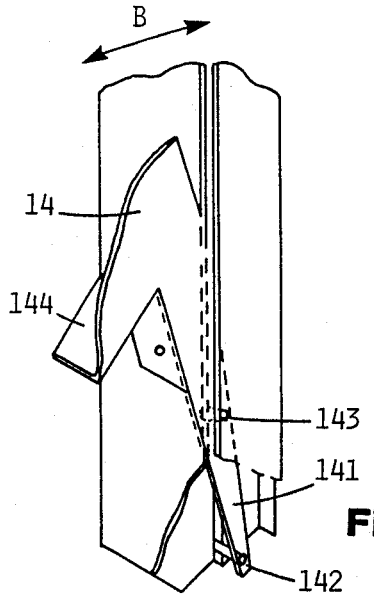
FIG. 2 is a larger-scale detail of area II in FIG. 1 with the housing removed.

When the plate is in the position illustrated in FIG. 2, it can be raised and lowered in the direction indicated by double-headed arrow A in FIG. 1. A pin 142 on the free end of tongue 141 prevents assembly plate 14 from slipping out of the strip. The assembly plate can pivot on pin 142 in the direction indicated by double-head arrow B in FIG. 2. Another pin 143 above pin 142 limits the extent that the plate can pivot.

Assembly plates 14 and 16 are pivoted out of positioning strips 11 and 12 and lowered onto the apron wall. A shutter housing 17 with the paneled shutter 20 itself inside it is positioned between them and secured with screws 18. Housing 17, which can travel along positioning strips 11 and 12 on assembly plates 14 and 16, is lifted toward the platband in the direction indicated by arrow A' in FIG. 1 and swung in the direction indicated by arrow B' in FIG. 1 into the empty space between the platband and the positioning strips.

The shutter 20 is arranged on the shutter shaft 201 which is held in end walls 171 and 172 of the shutter housing 17. The exit slot 174 provided in the bottom 173 of the housing 17 extends with the shutter guides 111, 121 in the shutter guide strips 11, 12.

The housing, which is now resting on top of the positioning strips, is indirectly secured to the strips with assembly plates 14 and 16. This can be done either by driving screws 19 through the strips and tongues in the direction indicated by arrow C in FIG. 3 or by driving a screw 19' into the strip through a securing tab 146 on the plate in the direction indicated by arrow C'.

Figure 4:
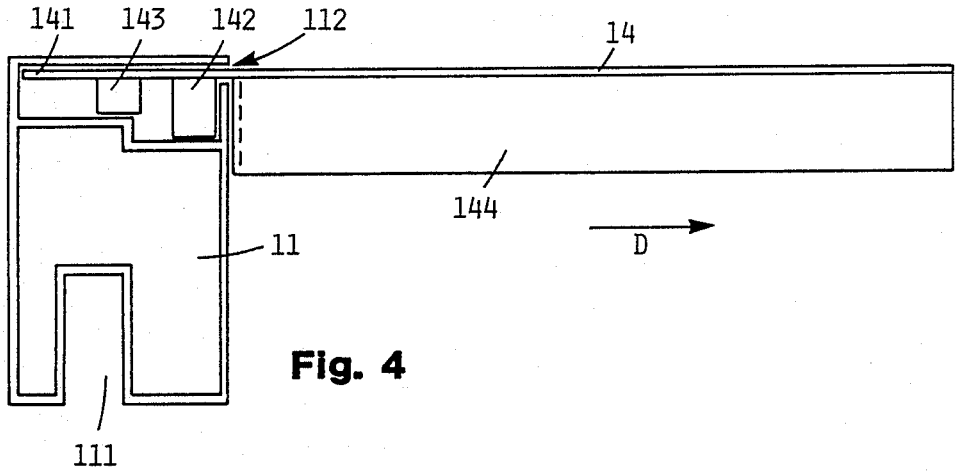
FIGS. 4 and 5 are horizontal sections through different types of positioning strips and their associated assembly plates.

FIG. 4 illustrates the functions of the pins 142 and 143 on tongue 141, which is an integral component of plate 14. Specifically, pin 142 prevents the plate from being removed from the strip in the direction indicated by arrow D in FIG. 4, and pin 143 limits the pivoting motion of the plate. Pin 143, which is shorter than pin 142 and positioned slightly above it, prevents assembly plate 14 from swinging too far out of the weather side of positioning strip 11 (toward the plane of projection of FIG. 4) when the plate is in the position illustrated in FIG. 2.

Figure 5:
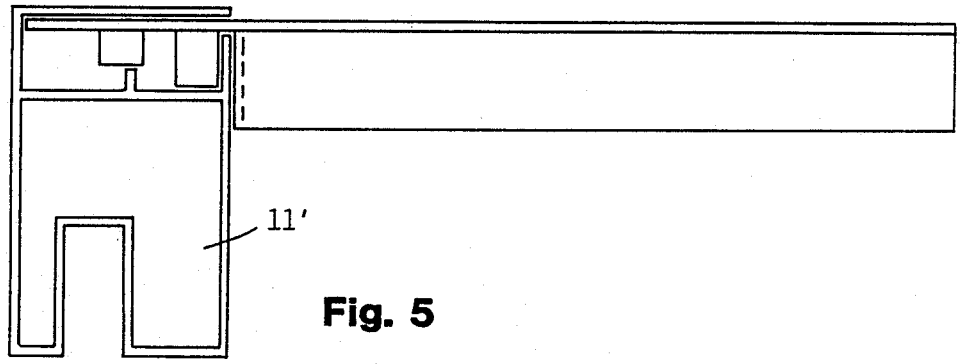

FIG. 5 illustrates a positioning strip 11' made out of a length of slightly different section.

Figure 6:
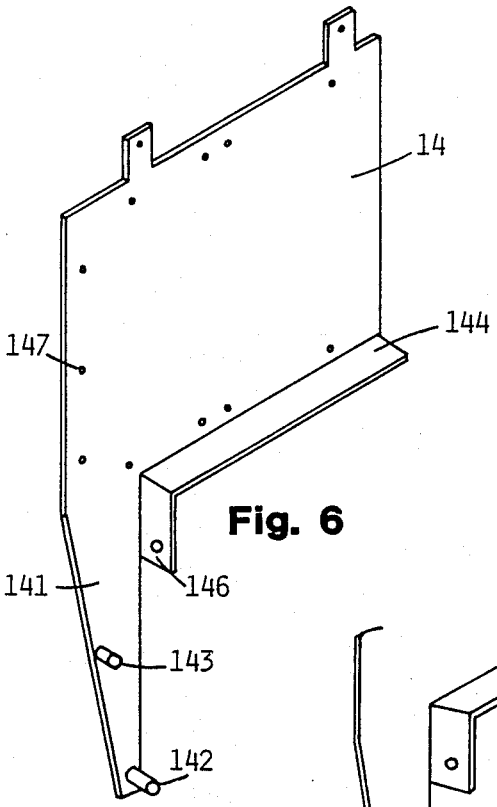
FIGS. 6 through 11 are schematic representations of various types of assembly plate.
Figure 7:
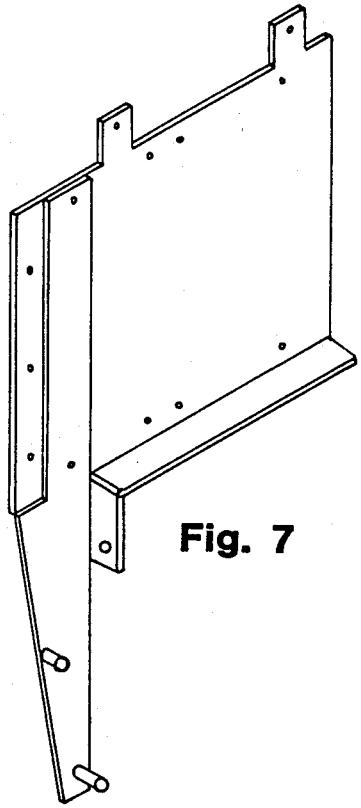
Figure 8:
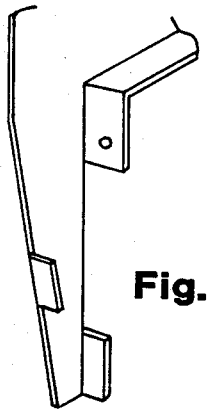
Figure 9:
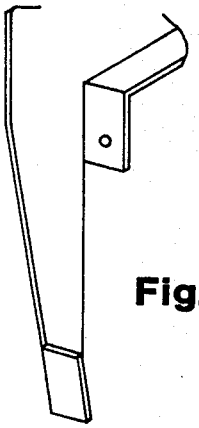
Figure 10:
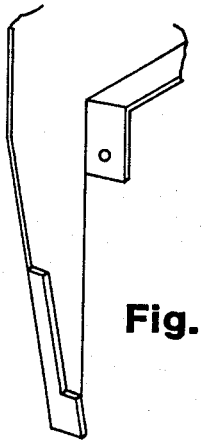

FIGS. 6 through 8 illustrate various versions of the assembly plate as employed with the exterior roll-up shutter illustrated in FIGS. 1 through 5. As well be evident from FIG. 8, stamped-out and bent-down portions of the edge positioning tongue can also be employed instead of pins as retainers and swing limiters. If, as illustrated for example in FIG. 10, the stamped-out and bent-down portion of the edge that functions as a retainer is long enough it can also act as a swing limiter.

Figure 11:
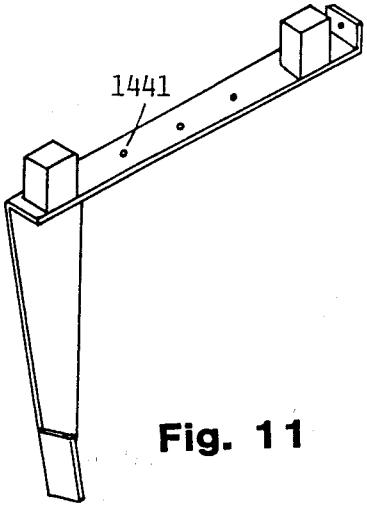

The assembly plates are in a practical way provided with a supporting arm, arm 144 on plate 14 for example, for housing 17 to rest on. The housing is of course secured with screws 18 extending through perforations 147 in the assembly plate into the side walls of the housing. The supporting arm in one version of the assembly plate, illustrated in FIG. 11, has projections that fit into matching recesses in the floor of the housing. The housing in this case is screwed directly onto the supporting arms through perforations 1441.

The embodiment of an exterior roll-up shutter previously described herein requires enough of a gap between the platband and the top of the positioning strips to accommodate the vertical dimension of the housing. Another embodiment can be employed when there is not enough space between the platband and the top of the positioning strip to allow housing 17 to swing into its final installation position in the direction indicated by arrow B' in FIG. 1. In this embodiment the assembly plates slide along but cannot pivot in the positioning strips, and the housing is temporarily and then finally secured in its final installation position with screws that extend through slots in arms that extend horizontally from the assembly plates and support the housing. This embodiment is illustrated in FIG. 12.

The supporting arms do not extend all the way to the rear of assembly plates 24 and 26, but terminate at the front face of positioning strip 21. The upright wall of each plate extends along with the positioning tongue, tongue 241 on arm 24 for instance, through a slit 212 that extends along the strip into an accommodation inside it. The plates slide up and down in the direction indicated by double-headed arrow E. With assembly plates 24 and 26 resting on the apron wall, housing 27 is initially positioned between them on the supporting arms, arm 244 for example, which are an integral part of each plate. The housing is then loosely secured in a forward position to the supporting arms with screws 28 extending through slots, slot 2441 for example, in the supporting arm. Next, housing 27 is slid up in the direction indicated by arrow E' along positioning strips 21 and 22, guided by the positioning tongues, tongue 241 for example, to its final installation level. Assembly plates 24 and 26 are then secured to positioning strips 21 and 22 respectively with screws, screw 29 for example, that pass through the securing arms, arm 246 for example. The screws securing housing 27 in its temporary forward position on the supporting arms are then partly unscrewed and the housing slid back along the supporting arms in the direction indicated by arrow F until the shutter exit in the floor of the housing is in alignment with the guide channels, channel 211 for example, in the positioning strips. The final position of the back wall of housing 27 is indicated by line H. The housing is finally permanently secured in this position on the supporting arms by tightening the screws 28' that extend through the slots.

Figure 12:
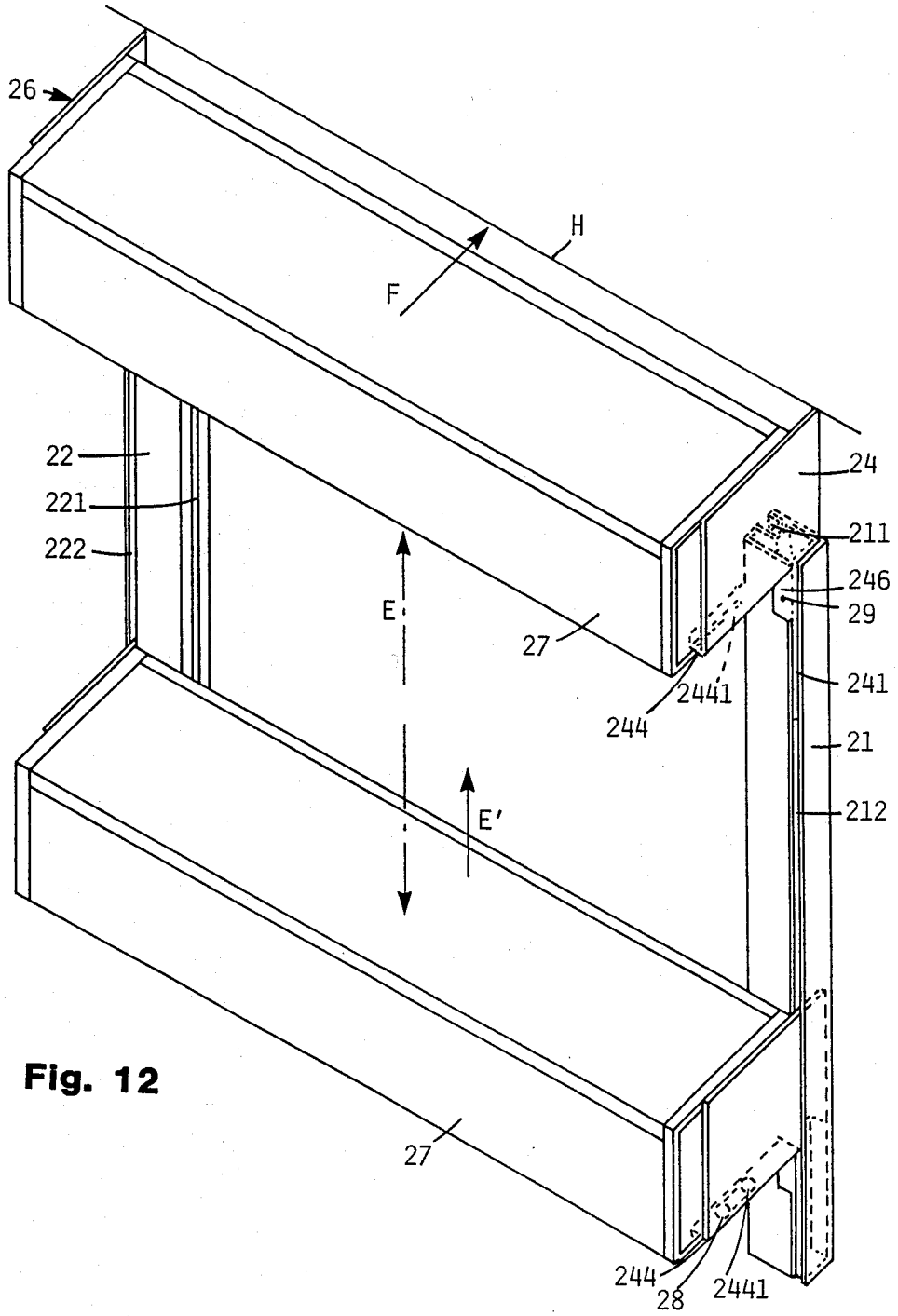
FIG. 12 is a schematic representation of another embodiment of the exterior roll-up shutter illustrating the housing during various stages of installation.
Figure 13:
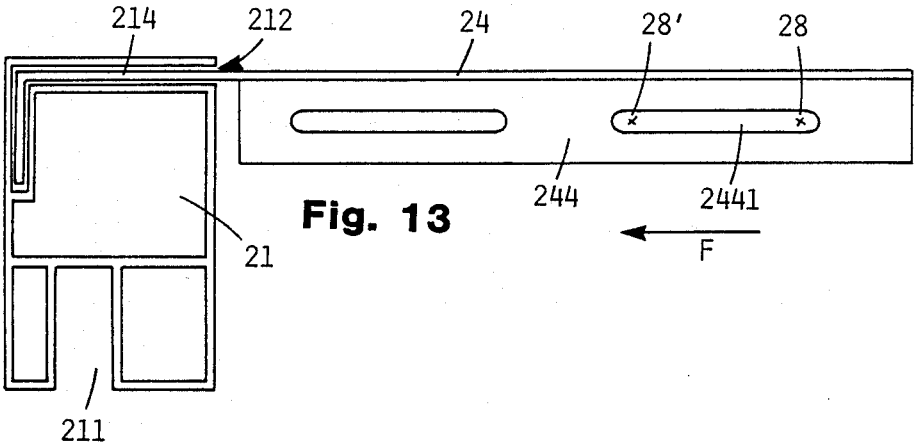
FIGS. 13 through 18 are horizontal sections through the embodiment illustrated in FIG. 12, illustrating positioning strips with different types of cross-section and various ways of using an assembly plate with them.
Figure 14:
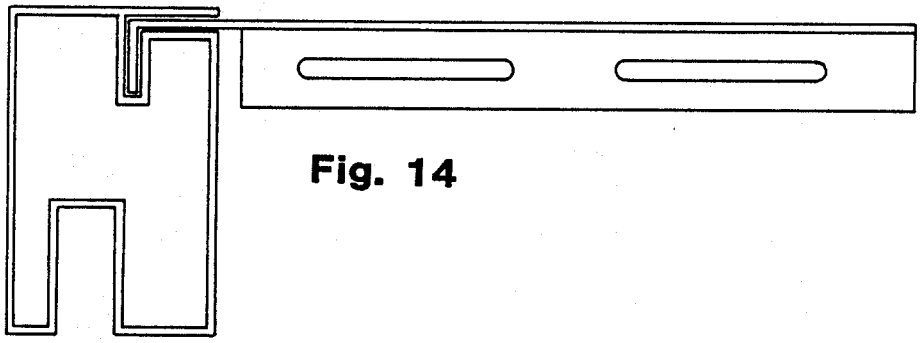
Figure 15:
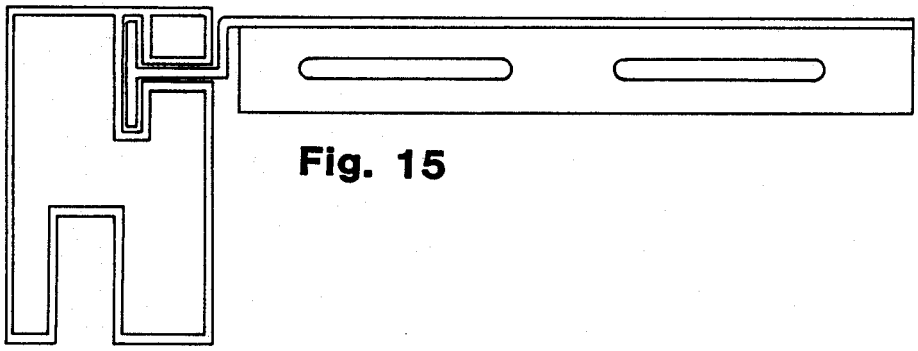
Figure 16:
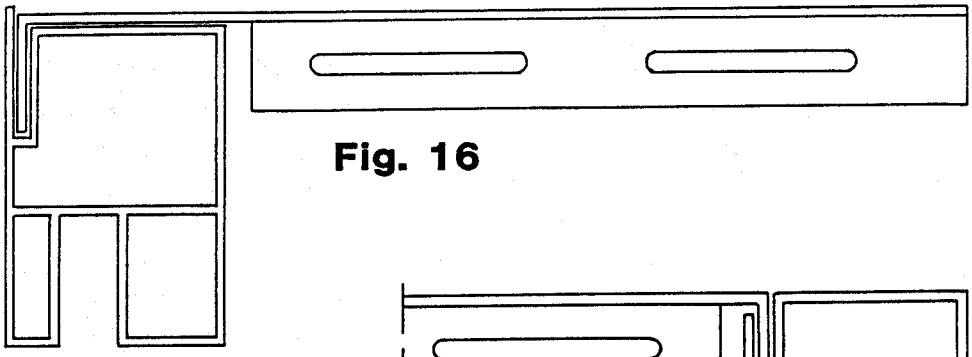
Figure 17:
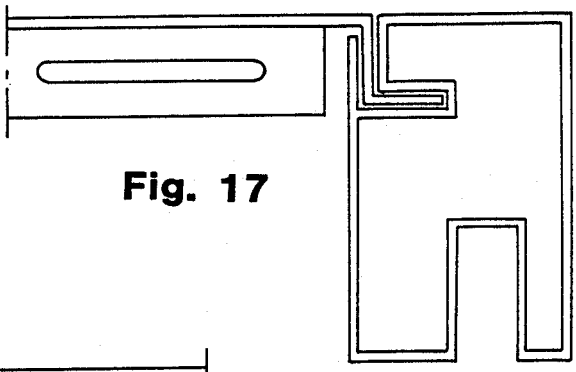

FIG. 13 is a horizontal section through the positioning strip employed in the embodiment illustrated in FIG. 12, showing its associated assembly plate. The reference numbers are the same as in FIG. 12.

FIGS. 14 through 17 illustrate further designs for the retainer that keeps the assembly plate or auxiliary assembly structure in the positioning strip.

Figure 18:
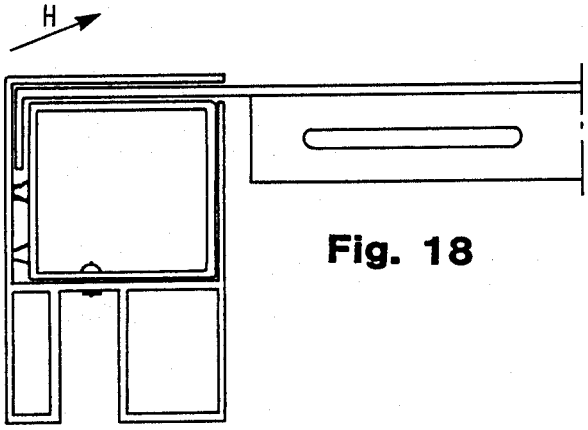

FIG. 18 illustrates a positioning strip made out of a length of plastic section reinforced or stiffened with a length of metal section.

Figure 19:
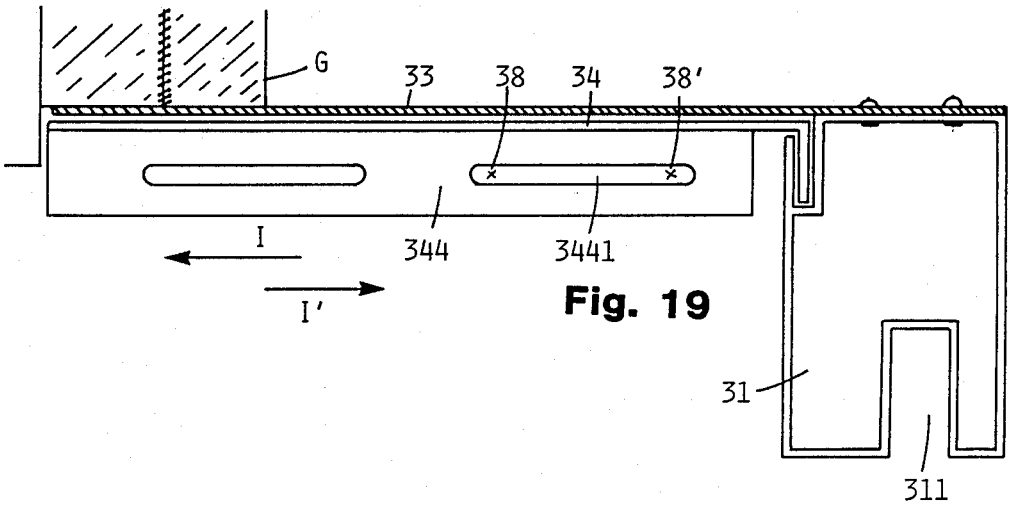
FIG. 19 is a horizontal section through a positioning strip and its associated assembly plate as employed in a special method of installing the exterior roll-up shutter illustrated in FIG. 12, FIGS. 20 and 21 are a schematic broken representation of and a horizontal section through another embodiment of the exterior roll-up shutter.

FIG. 19 illustrates an embodiment wherein a housing that is to be installed from inside the building is located in its final installation position on the outside of the wall like a sort of porch. The window aperture in outside wall G is indicated by arrow H. The positioning strips, strip 31 for example, are fastened to the reveal or to outside wall G with a strip holder 33 that projects beyond the wall. Assembly plates, plate 34 for example, slide along the positioning strips and attach to the ends of the housing as in the embodiment intended for installation from the outside. In this case, however, the assembly plates extend inward and the housing is initially displaced along the supporting arms, arm 344 for example, in the direction indicated by arrow I. The housing, after being raised to the installation level, is temporarily secured in this position on the supporting arms with screws 38 that extend through slots 3441. The screws are then partly unscrewed and the housing slid toward the positioning strip in the direction indicated by arrow I' until the shutter exit in the floor of the housing is in alignment with the guide channels, channel 311 for example, in the strip, and finally secured in that position with screws 38' that extend through slots 3441.

Figure 20:
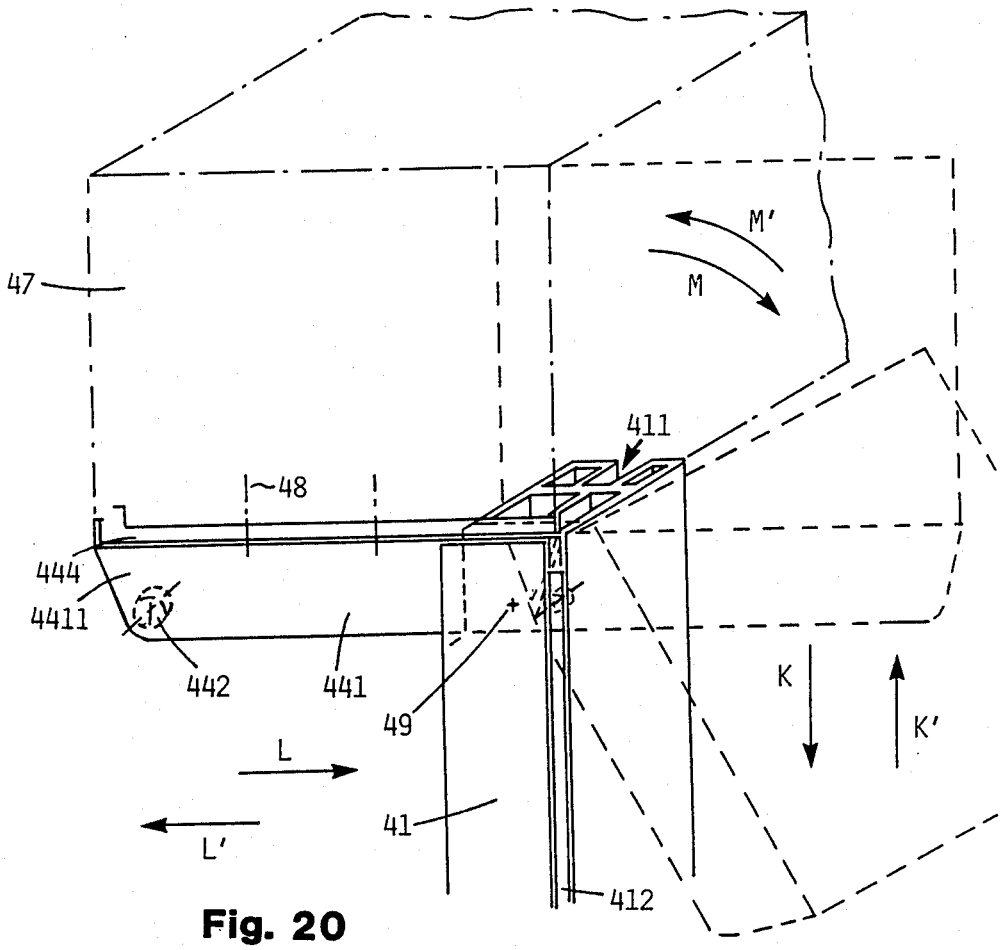
Figure 21:
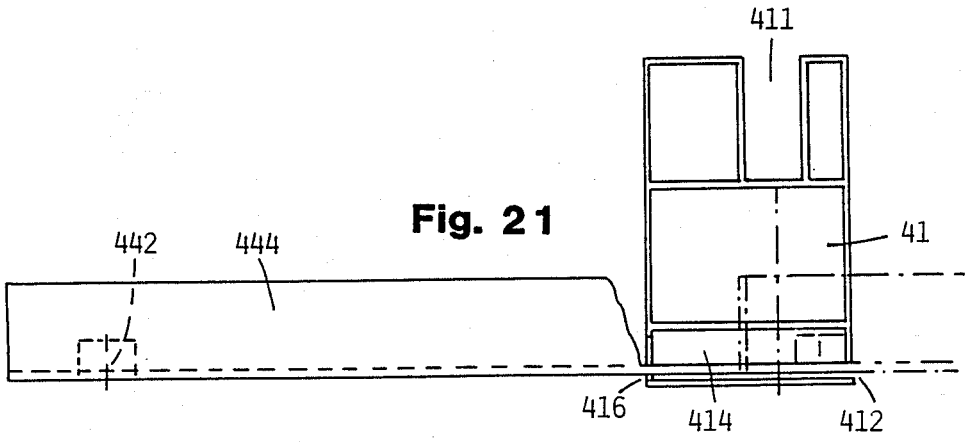

FIGS. 20 and 21 illustrate the method in accordance with the invention of installing an exterior roll-up shutter in such a way that the front wall of the housing will be aligned with the weather side of the positioning strips in the final installation position. There is also in this case an accommodation in each positioning strip, strip 41 for example, that is accessible from the weather side through a slit 412. An auxiliary assembly structure in the form of a supporting arm 444 slides along each positioning strip. The end 4411 of its web 441 can be raised and lowered in the direction indicated by double-headed arrow K. A retainer 442 at the end 4411 of positioning web 441 prevents supporting arm 444 from coming completely out of positioning strip 41 when the arm moves in the direction indicated by arrow L in FIG. 20 while allowing it to pivot in the direction indicated by arrow M. The housing 47 to be installed is initially connected to each supporting arm, arm 444 for example, at area 48 with the arm pivoted down and resting against the apron wall. The housing is then slid up along the positioning strips in the direction indicated by arrow K' and guided by the supporting arms in the strips to the top of the strips. Next, the housing is pivoted in the direction indicated by arrow M' into the intermediate installation position and shifted along with the supporting arms into the final installation position in the direction indicated by arrow L', with the shutter exit in its floor in alignment with the guide channel, channel 411 for example, in each positioning strip.

The supporting arm is allowed to slide in the direction indicated by arrow L' by a cutout 416 (FIG. 20) in the top and rear of the accommodations, accommodation 414 for example, that proYides access for positioning web 441 and its associated retainer 442. Web 441 is an integral component of each supporting arm. Finally, the supporting arms are permanently fastened to the positioning strips with screws 49.

If it is necessary or desirable to associate the housing with the supporting arm in the installation position from the very beginning as in the method described with reference to FIGS. 20 and 21, it can be done as illustrated in FIGS. 22 and 23. A bracket 645 pivots out from the free end of supporting arm 644 or of the positioning web 641 that is an integral component of the arm. The free end of bracket 645 leads through a guide slit 612 in positioning strip 61 into an accommodation inside the strip and is retained therein by a retainer 6451. The housing is secured in its installation position by a brace 6452 between supporting arm 644 and bracket 645. The brace 6452 is connected by a bolt at joint 6453 with the positioning web 641 of the supporting arm 644. The brace 6452 is also connected to the bracket 645 by a bolt at joint 6454. After lifting the shutter housing on the supporting arm 644 to the installation level, the bolt at joint 6454 is removed and the brace 6452 pivoted on supporting arm 644 together with the supporting arm is moved in the direction of arrow L in the installation position, in which the end regions of the shutter exit slot in the bottom of the housing extend over to the shutter guides in the shutter guide strips. In the installation position, the supporting arm 644 and therewith the connected housing become fixed by the bolt 6456 of the bracket 645 to the shutter positioning strip 61. Before releasing the brace 6452, the housing which was lifted to the installation level can be caught by a stamping supported on the window sill. The installation procedure that has been described, does not exclude that the brace 6452 can be fully removed before moving over the lifted housing in the installation situation by releasing the connections or joints 6453 and 6454 for reuse at the next assembly. In this case, the supporting arms must either be manufactured longer than the housing is deep or must telescope as illustrated in FIG. 22.

The invention has been described herein with reference to exemplary embodiments. It will be understood, however, that it is receptable of various modifications, which will offer themselves to those skilled in the art and which are intended to be encompassed within the protection sought for the invention as set forth in the appended claims.

I claim:

1. Exterior roll-up shutter comprising positioning strips with guide channels mountable on an outside wall on or next to reveals; a housing resting against said strips; said housing having side walls, a floor, a rear and front wall, and a ceiling, said shutter having a shaft and panels accommodated by said housing, said housing having a shutter exit extending along its floor in alignment with guide channels in said positioning strips; each positioning strip having a length of section with a shutter offset accessible from inside a window aperture; each positioning strip having a weather side and an accommodation extending along the whole strip and being accessible from the weather side; an auxiliary assembly structure permanently extending into the strip at a right angle to the strip, said housing being lifted over said positioning strip by said auxiliary assembly structure until said shutter exit in the floor of the housing is in alignment with said guide channels in said positioning strips, while allowing said housing to be freely maneuvered at an installation level at a window; and means connecting said accommodation and said auxiliary assembly structure for effecting lifting of said housing; said auxiliary assembly structure having hook means projecting hookingly in said accommodation.

2. Shutter as defined in claim 1, wherein said auxiliary assembly structure is a plate resting against a side wall of said housing.

3. Shutter as defined in claim 1, wherein said auxiliary assembly structure comprises an arm supporting the front of the housing.

4. Shutter as defined in claim 3, wherein said supporting arm is part of a plate resting against the side wall of the housing.

5. Shutter as defined in claim 1, wherein said auxiliary assembly structure is guided in said strip by a web and projects downward.

6. Shutter as defined in claim 1, wherein said auxiliary assembly structure is guided in said strip by a tongue extending down from the rear of a plate.

7. Shutter as defined in claim 6, wherein said auxiliary assembly structure comprises said plate and a supporting arm, said supporting arm having a cut-out section to fit against the positioning strip.

8. Shutter as defined in claim 7, wherein said cut-out section of said supporting arm is bent down to form a securing tab.

9. Shutter as defined in claim 1, wherein said auxiliary assembly structure has a plate extending along the total height of the housing, and has securing tabs that can be bent down against the ceiling of the housing.

10. Shutter as defined in claim 3, wherein said arm supporting said housing has slots for securing said housing in various positions in relation to said auxiliary assembly structure.

11. Shutter as defined in claim 1, wherein said auxiliary assembly structure has a positioning web with an end that extends through a slit providing access to accommodation in said positioning strip, said end comprising said hook means.

12. Shutter as defined in claim 1, wherein said assembly structure has a positioning web with an end, said accommodation for said positioning web on said auxiliary assembly structure in the positioning strip being accessible through a weather-side slit in the positioning strip and has a weather-side offset that extends along the whole strip, said end of said positioning web having a retainer that extends into and rotates in the offset.

13. Shutter as defined in claim 12, wherein said accommodation for the positioning web and said retainer in the positioning web for the auxiliary assembly structure being accessible from the weather side through a slit that extends along the positioning strip, said slit having a top cut out at the rear to admit said web and said retainer.

14. Shutter as defined in claim 12, including a bracket positioned for rotation and secured in relation to said positioning web on the weather-side end of the positioning web, said end leading through said slit that extends along the positioning strip; and a pin comprising said retainer in an offset in said accommodation.

15. Shutter as defined in claim 14, including a brace connected releasably to said positioning web and said bracket.

16. Shutter as defined in claim 6, wherein said accommodation for said tongue on the auxiliary assembly structure is accessible through a weather-side slit that extends along the positioning strip and has an offset extending along the strip on the weather side and engaging said tongue from a side of said plate facing away from the weather side to a free end of the positioning strip; and a retainer leading into the offset and a swing limiter that projects at some distance from said free end into said offset in the positioning strip.

17. Shutter as defined in claim 1, wherein said positioning strips are comprised of lengths of hollow section.

18. Shutter as defined in claim 17, wherein said section is multichambered, one chamber having a slit extending along the positioning strip and providing access to said accommodation.

19. Shutter as defined in claim 17, wherein said positioning strips are lengths of hollow plastic section reinforced with lengths of metal section.

20. A shutter as defined in claim 1, wherein said auxiliary assembly structure has a positioning web with an end that extends through a slit providing access to said accommodation in said positioning strip, said end comprising a hook on said auxiliary assembly structure engaging said accommodation; said positioning strips comprising lengths of hollow section; said section being multichambered, one chamber having a slit extending along the positioning strip and providing access to said accommodation said positioning strips being lengths of hollow plastic section reinforced with lengths of metal section.

21. A shutter as defined in claim 1, wherein said assembly structure has a positioning web with an end, said accommodation for said positioning web on said auxiliary assembly structure in the positioning strip being accessible through a weather-side slit in the positioning strip and has a weather-side offset that extends along the whole strip, said end of said positioning web having a retainer that extends into and rotates in the offset; said accommodation for the positioning web and said retainer in the positioning web for the auxiliary assembly structure being accessible from the weather side through a slit that extends along the positioning strip, said slit having a top cut out at the rear to admit said web and said retainer; a bracket positioned for rotation and secured in relation to said positioning web on the weather-side end of the positioning web, said end leading through said slit that extends along the positioning strip; and a pin comprising said retainer in an offset in said accommodation; a brace connected releasably to said positioning web and said bracket; said positioning strips comprising lengths of hollow plastic section reinforced with lengths of metal section; said section being multichambered, one chamber having a slit extending along the positioning strip and providing access to said accommodation.

22. Method of mounting exterior roll-up shutters comprising the steps of: fastening positioning strips equipped with auxiliary assembly structures to reveals of a window to be provided with a shutter; leaving enough space between tops of said positioning strips and a platband to accommodate a housing; fastening permanently said housing with the shutter inside thereof to said auxiliary assembly structures, said structures resting on an apron wall; sliding said housing up said positioning strips to the top of said strips with said auxiliary assembly structures extending into the strips with hook means; and shifting said housing over the top of the positioning strips, and securing said auxiliary assembly structures to said positioning strips with said housing in a final installation position.

23. Method of mounting exterior roll-up shutters comprising the steps of: fastening positioning strips equipped with auxiliary assembly structures to reveals of a window to be provided with a shutter; leaving enough space between tops of said positioning strips and a platband to accommodate a housing; fastening temporarily said housing with the shutter inside thereof to said auxiliary assembly structures by screws extending through slots in supporting arms on said auxiliary assembly structures and into a floor of the housing with the structures resting on an apron wall; sliding said housing up the positioning strips to the top of the strips with said auxiliary assembly structures extending into the strips with hook means; securing permanently said auxiliary assembly structures to the positioning strips; loosening partly said screws that temporarily fasten said housing to said auxiliary assembly structures and shifting said housing along the structures until a shutter exit in the floor of said housing comes into alignment with a guide channel in each positioning strip; and fastening permanently said housing to said auxiliary assembly structures in a final installation position by retightening said screws.

* * * * *